US006626635B1

(12) United States Patent
Prowse et al.

(10) Patent No.: US 6,626,635 B1
(45) Date of Patent: Sep. 30, 2003

(54) SYSTEM FOR CONTROLLING CLEARANCE BETWEEN BLADE TIPS AND A SURROUNDING CASING IN ROTATING MACHINERY

(75) Inventors: Kevin Joseph Prowse, Ballston Spa, NY (US); Howard Jay Kaplan, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 59 days.

(21) Appl. No.: 09/666,611

(22) Filed: Sep. 20, 2000

Related U.S. Application Data

(63) Continuation of application No. 09/163,389, filed on Sep. 30, 1998, now abandoned.

(51) Int. Cl.[7] ..... F01D 11/24
(52) U.S. Cl. ..... 415/1; 415/173.2
(58) Field of Search ..... 415/1, 13, 17, 415/47, 118, 126, 175, 177, 178, 179, 182.1, 220, 228, 173.1, 173.2

(56) References Cited

U.S. PATENT DOCUMENTS 4,005,946 A * 2/1977 Brown et al. ..... 415/178 X
4,251,185 A * 2/1981 Karstensen ..... 415/175 X
4,257,222 A * 3/1981 Schwarz ..... 415/175
4,338,061 A * 7/1982 Beitler et al. ..... 415/1
4,507,914 A * 4/1985 Rice ..... 415/178 X
4,513,567 A * 4/1985 Deveau et al. ..... 415/178 X
4,721,433 A * 1/1988 Piendel et al. ..... 415/115
4,804,310 A * 2/1989 Fuller et al. ..... 415/115
5,012,420 A * 4/1991 Walker et al. ..... 415/1
5,054,996 A * 10/1991 Carreno ..... 415/115
5,167,487 A * 12/1992 Rock ..... 415/173.3
5,205,115 A * 4/1993 Plemmons et al. ..... 415/115 X
5,605,437 A * 2/1997 Meylan ..... 415/1
5,667,358 A * 9/1997 Gaul ..... 415/173.1
5,779,442 A * 7/1998 Sexton et al. ..... 415/173.2
5,906,473 A * 5/1999 Sexton et al. ..... 415/173.2
5,967,743 A * 10/1999 Meylan ..... 415/115

OTHER PUBLICATIONS

"39th GE Turbine State–of–the–Art Technology Seminar", Tab 1,""F" Technology—the First Half Million Operating Hours", H.E. Miller.
"39th GE Turbine State–of–the–Art Technology Seminar", Tab 2, "GE Heavy–Duty Gas Turbine Performance Characteristics", F. J. Brooks.
"39th GE Turbine State–of–the–Art Technology Seminar", Tab 3, "9EC 50Hz 170–MW Class Gas Turbine", A.S. Arrao.

(List continued on next page.)

*Primary Examiner*—Edward K. Look
*Assistant Examiner*—Richard A. Edgar
(74) *Attorney, Agent, or Firm*—Nixon & Vanderhye

(57) ABSTRACT

The clearance control system includes a closed air circuit having a heat exchanger, a circulation compressor and an air heater in series for flowing air heated or cooled to higher and lower system-set discharge temperatures in the casing of rotating machinery to expand or contract the casing, respectively, to maintain optimum clearances between the rotating blade tips and the casing. At start-up, the air heater is energized to supply heated air to and expand the casing. During start-up and subsequent to this initial phase, the air heater is deenergized and the air cooling system is actuated by closing a heat exchanger bypass valve and opening a shutoff valve, enabling the air to be cooled in the heat exchanger. By controlling the flow of coolant to the heat exchanger, the lower set discharge temperature of the air exiting the circulation compressor can be regulated during steady-state operation to maintain the casing contracted for optimal clearance.

2 Claims, 2 Drawing Sheets

OTHER PUBLICATIONS

"39th GE Turbine State–of–the–Art Technology Seminar", Tab 4, "MWS6001FA—An Advanced–Technology 70–MW Class 50/60 Hz Gas Turbine", Ramachandran et al.
"39th GE Turbine State–of–the–Art Technology Seminar", Tab 5, "Turbomachinery Technology Advances at Nuovo Pignone", Benvenuti et al.
"39th GE Turbine State–of–the–Art Technology Seminar", Tab 6, "GE Aeroderivative Gas Turbines—Design and Operating Features", M.W. Horner.
"39th GE Turbine State–of–the–Art Technology Seminar", Tab 7, "Advance Gas Turbine Materials and Coatings", P.W. Schilke.
"39th GE Turbine State–of–the–Art Technology Seminar", Tab 8, "Dry Low $NO_x$ Combustion Systems for GE Heavy–Duty Turbines", L. B. Davis.
"39th GE Turbine State–of–the–Art Technology Seminar", Tab 9, "GE Gas Turbine Combustion Flexibility", M. A. Davi.
"39th GE Turbine State–of–the–Art Technology Seminar", Tab 10, "Gas Fuel Clean–Up System Design Considerations for GE Heavy–Duty Gas Turbines", C. Wilkes.
"39th GE Turbine State–of–the–Art Technology Seminar", Tab 11, "Integrated Control Systems, for Advanced Combined Cycles", Chu et al.
"39th GE Turbine State–of–the–Art Technology Seminar", Tab 12, "Power Systems for the 21st Century "H" Gas Turbine Combined Cycles", Paul et al.
"39th GE Turbine State–of–the–Art Technology Seminar", Tab 13, "Clean Coal and Heavy Oil Technologies for Gas Turbines", D. M. Todd.
"39th GE Turbine State–of–the–Art Technology Seminar", Tab 14, "Gas Turbine Conversions, Modifications and Uprates Technology", Stuck et al.
"39th GE Turbine State–of–the–Art Technology Seminar", Tab 15, "Performance and Reliability Improvements for Heavy–Duty Gas Turbines, "J. R. Johnston.
"39th GE Turbine State–of–the–Art Technology Seminar", Tab 16, "Gas Turbine Repair Technology", Crimi et al.
"39th GE Turbine State–of–the–Art Technology Seminar", Tab 17, "Heavy Duty Turbine Operating & Maintenance Considerations", R. F. Hoeft.
"39th GE Turbine State–of–the–Art Technology Seminar", Tab 18, "Gas Turbine Performance Monitoring and Testing", Schmitt et al.
"39th GE Turbine State–of–the–Art Technology Seminar", Tab 19, "Monitoring Service Delivery System and Diagnostics", Madej et al.
"39th GE Turbine State–of–the–Art Technology Seminar", Tab 20, "Steam Turbines for Large Power Applications", Reinker et al.
"39th GE Turbine State–of–the–Art Technology Seminar", Tab 21, "Steam Turbines for Ultrasupercritical Power Plants", Retzlaff et al.
"39th GE Turbine State–of–the–Art Technology Seminar", Tab 22, "Steam Turbine Sustained Efficiency", P. Schofield.
"39th GE Turbine State–of–the–Art Technology Seminar", Tab 23, "Recent Advances in Steam Turbines for Industrial and Cogeneration Applications", Leger et al.
"39th GE Turbine State–of–the–Art Technology Seminar", Tab 24, "Mechanical Drive Steam Turbines", D. R. Leger.
"39th GE Turbine State–of–the–Art Technology Seminar", Tab 25, "Steam Turbines for STAG™ Combined–Cycle Power Systems", M. Boss.
"39th GE Turbine State–of–the–Art Technology Seminar", Tab 26, "Cogeneration Application Considerations", Fisk et al.
"39th GE Turbine State–of–the–Art Technology Seminar", Tab 27, "Performance and Economic Considerations of Repowering Steam Power Plants", Stoll et al.
"39th GE Turbine State–of–the–Art Technology Seminar", Tab 28, "High–Power–Density™ Steam Turbine Design Evolution", J. H. Moore.
"39th GE Turbine State–of–the–Art Technology Seminar", Tab 29, "Advances in Steam Path Technologies", Cofer, IV, et al.
"39th GE Turbine State–of–the–Art Technology Seminar", Tab 30, "Upgradable Opportunities for Steam Turbines", D. R. Dreier, Jr.
"39th GE Turbine State–of–the–Art Technology Seminar", Tab 31, "Uprate Options for Industrial Turbines", R. C. Beck.
"39th GE Turbine State–of–the–Art Technology Seminar", Tab 32, "Thermal Performance Evaluation and Assessment of Steam Turbine Units", P. Albert.
"39th GE Turbine State–of–the–Art Technology Seminar", Tab 33, "Advances in Welding Repair Technology" J. F. Nolan.
"39th GE Turbine State–of–the–Art Technology Seminar", Tab 34, "Operation and Maintenance Strategies to Enhance Plant Profitability", MacGillivray et al.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Product Line and Performance", Chase, et al.
"39th GE Turbine State–of–the–Art Technology Seminar", Tab 38, "GE Combined Cycle Experience", Maslak et al.
"39th GE Turbine State–of–the–Art Technology Seminar", Tab 39, "Single–Shaft Combined Cycle Power Generation Systems", Tomlinson et al.
"Advanced Turbine System Program—Conceptual Design and Product Development", Annual Report, Sep. 1, 1994–Aug. 31, 1995.
"Advanced Turbine Systems (ATS Program) Conceptual Design and Product Development", Final Technical Progress Report, Vol. 2–Industrial Machine, Mar. 31, 1997, Morgantown, WV.
"Advanced Turbine Systems (ATS Program) Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993–Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.

"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Numbers DE–FC21–95MC31176–11.
"Exhibit panels used at 1995 product introduction at PowerGen Europe".
"Extensive Testing Program Validates High Efficiency, reliability of GE's Advanced "H" Gas Turbine Technology", Press Information, Press Release, 96–NR14, Jun. 26, 1996, H Technology Tests pp. 1–4.
"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp.1–6.
"Gas, Steam Turbine Work as Single Unit in GE's Advanced H Technology Combined–Cycle System", Press Information, Press Release, 95–NR18, May 16, 1995, Advanced Technology Introduction/pp. 1–3.
"GE Breaks 60% Net Efficiency Barrier" paper, 4 pages.
"GE Businesses Share Technologies and Experts to Develop State–Of–The–Art Products", Press Information, Press Release 95–NR10, May 16, 1995, GE Technology Transfer/pp. 1–3.
"General Electric ATS Program Technical Review, Phase 2 Activities", T. Chance et al., pp. 1–4.
"General Electric's DOE/ATS H Gas Turbine Development" Advanced Turbine Systems Annual Review Meeting, Nov. 7–8, 1996, Washington, D.C., Publication Release.
"H Technology Commercialization", 1998 MarComm Activity Recommendation, Mar., 1998.
"H Technology", Jon Ebacher, VP, Power Gen Technology, May 8, 1998.
"H Testing Process", Jon Ebacher, VP, Power Gen Technology, May 8, 1998.
"Heavy–Duty & Aeroderivative Products" Gas Turbines, Brochure, 1998.
"MS7001H/MS9001H Gas Turbine, gepower.com website for PowerGen Europe" Jun. 1–3 going public Jun. 15, (1995).
"New Steam Cooling System is a Key to 60% Efficiency for GE "H" Technology Combined–Cycle Systems", Press Information, Press Release, 95–NRR16, May 16, 1995, H Technology/pp. 1–3.
"Overview of GE's H Gas Turbine Combined Cycle", Jul. 1, 1995 to Dec. 31, 1997.
"Power Systems for the 21$^{st}$Century —"H" Gas Turbine Combined Cycles", Thomas C. Paul et al., Report.
"Power–Gen '96 Europe", Conference Programme, Budapest, Hungary, Jun. 26–28, 1996.
"Power–Gen International", 1998 Show Guide, Dec. 9–11, 1998, Orange County Convention Center, Orlando, Florida.
"Press Coverage following 1995 product announcement"; various newspaper clippings relating to improved generator.
"Proceedings of the Advanced Turbine Systems Annual Program Review Meeting", vol. I, "Industrial Advanced Turbine Systems Program Overview", D.W. Esbeck, p. 3.
"Proceedings of the Advanced Turbine Systems Annual Program Review Meeting", vol. I, "H Gas Turbine Combined Cycle", J. Corman, p. 14.
"Proceedings of the Advanced Turbine Systems Annual Program Review Meeting", vol. I, "Overview of Westinghouse's Advanced Turbine Systems Program", Bannister et al., p. 22.
"Proceedings of the Advanced Turbine Systems Annual Program Review Meeting", vol. I, "Allison Engine ATS Program Technical Review", D. Mukavetz, p. 31.
"Proceedings of the Advanced Turbine Systems Annual Program Review Meeting", vol. I, "Advanced Turbine Systems, Program Industrial System Concept Development", S. Gates, p. 43.
"Proceedings of the Advanced Turbine Systems Annual Program Review Meeting", vol. I, "Advanced Turbine System Program Phase 2 Cycle Selection", Latcovich, Jr., p. 64.
"Proceedings of the Advanced Turbine Systems Annual Program Review Meeting", vol. I, "General Electric ATS Program Technical Review Phase 2 Activities", Chance et al., p. 70.
"Proceedings of the Advanced Turbine Systems Annual Program Review Meeting", vol. I, "Technical Review of Westinghouse's Advanced Turbine Systems Program", Diakunchak et al., p. 75.
"Proceedings of the Advanced Turbine Systems Annual Program Review Meeting", vol. I, "Advanced Combustion Turbines and Cycles: An EPRI Perspective", Touchton et al., p. 87.
"Proceedings of the Advanced Turbine Systems Annual Program Review Meeting", vol. I, "Advanced Turbine Systems Annual Program Review", William E. Koop, p. 89.
"Proceedings of the Advanced Turbine Systems Annual Program Review Meeting", vol. I, "The AGTSR Consortium: An Update", Fant et al., p. 93.
"Proceedings of the Advanced Turbine Systems Annual Program Review Meeting", vol. I, "Overview of Allison/AGTSR Interactions", Sy A. Ali, p. 103.
"Proceedings of the Advanced Turbine Systems Annual Program Review Meeting", vol. I, "Design Factors for Stable Lean Premix Combustion", Richards et al., p. 107.
"Proceedings of the Advanced Turbine Systems Annual Program Review Meeting", vol. I, "Ceramic Stationary as Turbine", M. van Roode, p. 114.
"Proceedings of the Advanced Turbine Systems Annual Program Review Meeting", vol. I, "DOE/Allison Ceramic Vane Effort", Wenglarz et al., p. 148.
"Proceedings of the Advanced Turbine Systems Annual Program Review Meeting", vol. I, "Materials/Manufacturing Element of the Advanced Turbine Systems Program", Karnitz et al., p. 152.
"Proceedings of the Advanced Turbine Systems Annual Program Review Meeting", vol. I, "Land–Based Turbine Casting Initiative", Mueller et al., p. 161.
"Proceedings of the Advanced Turbine Systems Annual Program Review Meeting", vol. I, "Pratt & Whitney Thermal Barrier Coatings", Bornstein et al., p. 182.
"Proceedings of the Advanced Turbine Systems Annual Program Review Meeting", vol. I, "Westinhouse Thermal Barrier Coatings", Goedjen et al., p. 194.
"Proceedings of the Advanced Turbine Systems Annual Program Review Meeting", vol. I, "High Performance Steam Development", Duffy et al., p. 200.
"Proceedings of the Advanced Turbine Systems Annual Program Review Meeting", vol. II, "Lean Premixed Combustion Stabilized by Radiation Feedback and heterogeneous Catalysis", Dibble et al., p. 221.

"Proceedings of the Advanced Turbine Systems Annual Program Review Meeting", vol. II, Rayleigh/Raman/LIF Measurements in a Turbulent Lean Premixed Combustor, Nandula et al. p. 233.

"Proceedings of the Advanced Turbine Systems Annual Program Review Meeting", vol. II, "Lean Premixed Flames for Low $No_x$ Combustors", Sojka et al., p. 249.

"Proceedings of the Advanced Turbine Systems Annual Program Review Meeting", vol. II, "Functionally Gradient Materials for Thermal Barrier Coatings in Advanced Gas Turbine Systems", Banovic et al., p. 276.

"Proceedings of the Advanced Turbine Systems Annual Program Review Meeting", vol. II, "Advanced Turbine Cooling, Heat Transfer, and Aerodynamic Studies", Han et al., p. 281.

"Proceedings of the Advanced Turbine Systems Annual Program Review Meeting", vol. II, "Life Prediction of Advanced Materials for Gas Turbine Application", Zamrik et al., p. 310.

"Proceedings of the Advanced Turbine Systems Annual Program Review Meeting", vol. II, "Advanced Combustion Technologies for Gas Turbine Power Plants", Vandsburger et al., p. 328.

"Proceedings of the Advanced Turbine Systems Annual Program Review Meeting", vol. II, "Combustion Modeling in Advanced Gas Turbine Systems", Smoot et al., p. 353.

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. p. 371.

"Proceedings of the Advanced Turbine Systems Annual Program Review Meeting", vol. II, "Rotational Effects on Turbine Blade Cooling", Govatzidakia et al., p. 391.

"Proceedings of the Advanced Turbine Systems Annual Program Review Meeting", vol. II, "Manifold Methods for Methane Combustion", Yang et al., p. 393.

"Proceedings of the Advanced Turbine Systems Annual Program Review Meeting", vol. II, "Advanced Multistage Turbine Blade Aerodynamics, Performance, Cooling, and Heat Transfer", Fleeter et al., p. 410.

"Proceedings of the Advanced Turbine Systems Annual Program Review Meeting, vol. II", The Role of Reactant Unmixedness, Strain Rate, and Length Scale on Premixed Combustor Performance, Samuelsen et al., p. 415.

"Proceedings of the Advanced Turbine Systems Annual Program Review Meeting", vol. II, "Experimental and Computational Studies of Film Cooling With Compound Angle Injection", Goldstein et al., p. 423.

"Proceedings of the Advanced Turbine Systems Annual Program Review Meeting", vol. II, "Compatibility of Gas Turbine Materials with Stem Cooling", Desai et al., p. 452.

"Proceedings of the Advanced Turbine Systems Annual Program Review Meeting", vol. II, "Use of a Laser–Induced Fluorescence Thermal Imaging System for Film Cooling Heat Transfer Measurement"M. K. Chyu, p. 465.

"Proceedings of the Advanced Turbine Systems Annual Program Review Meeting", vol. II, Effects of Geometry on Slot–Jet Film Cooling Performance, Hyams et al., p. 474.

"Proceedings of the Advanced Turbine Systems Annual Program Review Meeting", vol. II, "Steam as Turbine Blade Coolant: Experimental Data Generation", Wilmsen et al., p. 497.

"Proceedings of the Advanced Turbine Systems Annual Program Review Meeting", vol. II, "Combustion Chemical Vapor Deposited Coatings for Thermal Barrier Coating Systems", Hampikian et al., p. 506.

"Proceedings of the Advanced Turbine Systems Annual Program Review Meeting", vol. II, "Premixed Burner Experiments: Geometry, Mixing, and Flame Structure Issues", Gupta et al., p. 516.

"Proceedings of the Advanced Turbine Systems Annual Program Review Meeting", vol. II, "Intercooler Flow Path for Gas Turbines: CFD Design and Experiments", Agrawal et al., p. 529.

"Proceedings of the Advanced Turbine Systems Annual Program Review Meeting", vol. II, "Bond Strength and Stress Measurements in Thermal Barrier Coatings", Gell et al., p. 539.

"Proceedings of the Advanced Turbine Systems Annual Program Review Meeting", vol. II, "Active Control of Combustion Instabilities in Low $NO_x$ Gas Turbines", Zinn et al., p. 550.

"Proceedings of the Advanced Turbine Systems Annual Program Review Meeting", vol. II, "Combustion Instability Modeling and Analysis", Santoro et al., p. 552.

"Proceedings of the Advanced Turbine Systems Annual Program Review Meeting", vol. II, "Flow and Heat Transfer in Gas Turbine Disk Cavities Subject to Nonuniform External Pressure Field", Roy et al., p. 560.

"Proceedings of the Advanced Turbine Systems Annual Program Review Meeting", vol. II, "Heat Pipe Turbine Vane Cooling", Langston et al., p. 566.

"Proceedings of the Advanced Turbine Systems Annual Program Review Meeting", vol. II, "Improved Modeling Techniques for Turbomachinery Flow Fields", Lakshminarayana et al., p. 573.

"Proceedings of the Advanced Turbine Systems Annual Program Review Meeting", vol. II, "Advanced 3D Inverse Method for Designing Turbomachine Blades", T. Dang, p. 582.

"Proceedings of the Advanced Turbine Systems Annual Program Review Meeting", "ATS and the Industries of the Future", Denise Swink, p. 1.

"Proceedings of the Advanced Turbine Systems Annual Program Review Meeting", "Gas Turbine Association Agenda", William H. Day, p. 3.

"Proceedings of the Advanced Turbine Systems Annual Program Review Meeting", "Power Needs in the Chemical Industry", Keith Davidson, p. 17.

"Proceedings of the Advanced Turbine Systems Annual Program Review Meeting", "Advanced Turbine Systems Program Overview", David Esbeck, p. 27.

"Proceedings of the Advanced Turbine Systems Annual Program Review Meeting", "Westinghouse's Advanced Turbine Systems Program", Gerard McQuiggan, p. 35.

"Proceedings of the Advanced Turbine Systems Annual Program Review Meeting", "Overview of GE's H Gas Turbine Combined Cycle", Cook et al., p. 49.

"Proceedings of the Advanced Turbine Systems Annual Program Review Meeting", "Allison Advanced Simple Cycle Gas Turbine System", William D. Weisbrod, p. 73.

"Proceedings of the Advanced Turbine Systems Annual Program Review Meeting", "The AGTSR Industry–University Consortium", Lawrence P. Golan, p. 95.

"Proceedings of the Advanced Turbine Systems Annual Program Review Meeting", "$NO_x$ and CO Emissions Models for Gas–Fired Lean–Premixed Combustion Turbines", A. Mellor, p. 111.
"Proceedings of the Advanced Turbine Systems Annual Program Review Meeting", "Methodologies for Active Mixing and Combustion Control", Uri Vandsburger, p. 123.
"Proceedings of the Advanced Turbine Systems Annual Program Review Meeting", "Combustion Modeling in Advanced Gas Turbine Systems", Paul O. Hedman, p. 157.
"Proceedings of the Advanced Turbine Systems Annual Program Review Meeting", "Manifold Methods for Methane Combustion", Stephen B. Pope, p. 181.
"Proceedings of the Advanced Turbine Systems Annual Program Review Meeting", "The Role of Reactant Unmixedness, Strain Rate, and Length Scale on Premixed Combustor Performance", Scott Samuelsen, p. 189.
"Proceedings of the Advanced Turbine Systems Annual Program Review Meeting", "Effect of Swirl and Momentum Distribution on Temperature Distribution in Premixed Flames", Ashwani K. Gupta, p. 211.
"Proceedings of the Advanced Turbine Systems Annual Program Review Meeting", "Combustion Instability Studies Application to Land–Based Gas Turbine Combustors", Robert J. Santoro, p. 233.
"Proceedings of the Advanced Turbine Systems Annual Program Review Meeting", "Active Control of Combustion Instabilities in Low $NO_x$ Turbines", Ben T. Zinn, p. 253.
"Proceedings of the Advanced Turbine Systems Annual Program Review Meeting", "Life Prediction of Advanced Materials for Gas Turbine Application," Sam Y. Zamrik, p. 265.
"Proceedings of the Advanced Turbine Systems Annual Program Review Meeting", "Combustion Chemical Vapor Deposited Coatings for Thermal Barrier Coating Systems", W. Brent Carter, p. 275.
"Proceedings of the Advanced Turbine Systems Annual Program Review Meeting", "Compatibility of Gas Turbine Materials with Steam Cooling", Vimal Desai, p. 291.
"Proceedings of the Advanced Turbine Systems Annual Program Review Meeting", "Bond Strength and Stress Measurements in Thermal Barrier Coatings", Maurice Gell, p. 315.
"Proceedings of the Advanced Turbine Systems Annual Program Review Meeting", "Advanced Multistage Turbine Blade Aerodynamics, Performance, Cooling and Heat Transfer", Sanford Fleeter, p. 335.
"Proceedings of the Advanced Turbine Systems Annual Program Review Meeting", "Flow Characteristics of an Intercooler System for Power Generating Gas Turbines", Ajay K. Agrawal, p. 357.
"Proceedings of the Advanced Turbine Systems Annual Program Review Meeting", "Improved Modeling Techniques for Turbomachinery Flow Fields", B. Lakshiminarayana, p. 371.
"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, p. 393.
"Proceedings of the Advanced Turbine Systems Annual Program Review Meeting", "Advanced Turbine Cooling, Heat Transfer, and Aerodynamic Studies", Je–Chin Han, p. 407.
"Proceedings of the Advanced Turbine Systems Annual Program Review Meeting", "Heat Transfer in a Two–Pass Internally Ribbed Turbine Blade Coolant Channel with Vortex Generators", S. Acharya, p. 427.
"Proceedings of the Advanced Turbine Systems Annual Program Review Meeting", "Experimental and Computational Studies of Film Cooling with Compound Angle Injection", R. Goldstein, p. 447.
"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, p. 461.
"Proceedings of the Advanced Turbine Systems Annual Program Review Meeting", "Steam as a Turbine Blade Coolant: External Side Heat Transfer", Abraham Engeda, p. 471.
"Proceedings of the Advanced Turbine Systems Annual Program Review Meeting", "Flow and Heat Transfer in Gas Turbine Disk Cavities Subject to Nonuniform External Pressure Field", Ramendra Roy, p. 483.
"Proceedings of the Advanced Turbine Systems Annual Program Review Meeting", "Closed–Loop Mist/Steam Cooling for Advanced Turbine Systems", Ting Wang, p. 499.
"Proceedings of the Advanced Turbine Systems Annual Program Review Meeting", "Heat Pipe Turbine Vane Cooling", Langston et al., p. 513.
"Proceedings of the Advanced Turbine Systems Annual Program Review Meeting", "EPRI's Combustion Turbine Program: Status and Future Directions", Arthur Cohn, p. 535.
"Proceedings of the Advanced Turbine Systems Annual Program Review Meeting", "ATS Materials Suport", Michael Karnitz, p. 553.
"Proceedings of the Advanced Turbine Systems Annual Program Review Meeting", "Land Based Turbine Casting Initiative", Boyd A. Meuller, p. 577.
"Proceedings of the Advanced Turbine Systems Annual Program Review Meeting", "Turbine Airfoil Manufacturing Technology", Charles S. Kortovich, p. 593.
"Proceedings of the Advanced Turbine Systems Annual Program Review Meeting", "Hot Corrosion Testing of TBS's", Norman Bornstein, p. 623.
"Proceedings of the Advanced Turbine Systems Annual Program Review Meeting", "Ceramic Stationary Gas Turbine", Mark van Roode, p. 633.
"Proceedings of the Advanced Turbine Systems Annual Program Review Meeting", "Western European Status of Ceramics for Gas Turbines", Tibor Bornemisza, p. 659.
"Proceedings of the Advanced Turbine Systems Annual Program Review Meeting", "Status of Ceramic Gas Turbines in Russia", Mark van Roode, p. 671.
"Status Report: The U.S. Department of of Energy's Advanced Turbine Systems Program", facsimile dated Nov. 7, 1996.
"Testing Program Results Validate GE's H Gas Turbine—High Efficiency, Low Cost of Eelctricity and Low Emissions", Roger Schonewald and Patrick Marolda.
"Testing Program Results Validate GE's Gas Turbine—High Efficiency, Low Cost of Eelctricity and Low Emissions", Slide Presentation—working draft.
"The Next Step In H . . . For Low Cost Per kW–Hour Power Generation", LP–1 PGE '98.

"Utility Advanced Turbine System (ATS) Technology Readiness Testing and Pre–Commercialization Demonstration", Document #486040, Oct. 1–Dec. 31, 1996, Publication Date, Jun. 1, 1997, Report Numbers: DOE/MC/31176–5628.

"Utility Advanced Turbine System (ATS) Technology Readiness Testing—Phase 3", Document #666274 Oct. 1, 1996–Sep. 30, 1997, Publication Date, Dec. 31, 1997, Report Numbers: DOE/MC/31176–10.

"Utility Advanced Turbine System (ATS) Technology Readiness Testing and Pre–Commercial Demonstration, Phase 3", Document #486029, Oct. 1–Dec. 31, 1995, Publication Date, May 1, 1997, Report Numbers: DOE/MC/31176 5340.

"Utility Advanced Turbine System (ATS) Technology Readiness Testing and Pre–Commercial Demonstration, Phase 3", Document #486132, Apr. 1–Jun. 30, 1976, Publication Date, Dec. 31, 1996, Report Numbers: DOE/MC/31176–5660.

"Utility Advanced Turbine System (ATS) Technology Readiness Testing and Pre–Commercial Demonstration—Phase 3", Document #587906, Jul. 1–Sep. 30, 1995, Publication Date, Dec. 31, 1995, Report Numbers: DOE/MC31176–5339.

"Utility Advanced Turbine System (ATS) Technology Readiness Testing and Pre–Commercial Demonstration," Document #666277, Apr. 1–Jun. 30, 1997, Publication Date, Dec. 31, 1997, Report Numbers: DOE/MC/31176–8.

"Utility Advanced Turbine System (ATS) Technology Readiness Testing and Pre–Commercialization Demonstration"Jan. 1–Mar. 31, 1996, DOE/MC/31176–5338.

"Utility Advanced Turbine System (ATS) Technology Readiness Testing: Phase 3R", Document #756552, Apr. 1–Jun. 30, 1999, Publication Date, Sep. 1, 1999, Report Numbers: DE–FC21–95MC31176–23.

"Utility Advanced Turbine System (ATS) Technology Readiness Testing.", Document #656823, Jan. 1–Mar. 31, 1998, Publication Date, Aug. 1, 1998, Report Numbers: DOE/MC/31176–17.

"Utility Advanced Turbine System (ATS) Technology Readiness Testing and Pre–Commercial Demonstration", Annual Technical Progress Report, Reporting Period: Jul. 1, 1995–Sep. 30, 1996.

"Utility Advanced Turbine System (ATS) Technology Readiness Testing", Phase 3R, Annual Technical Progress Report, Reporting Period: Oct. 1, 1997–Sep. 30, 1998.

"Utility Advanced Turbine System (ATS) Technology Readiness Testing", Document #750405, Oct. 1–Dec. 30, 1998, Publication Date: May, 1, 1999, Report Numbers: DE–FC21–95MC31176–20.

"Utility Advanced Turbine System (ATS) Technology Readiness Testing", Document #1348, Apr. 1–Jun. 29, 1998, Publication Date Oct. 29, 1998, Report Numbers DE–FC21–95MC31176–18.

"Utility Advanced Turbine System (ATS) Technology Readiness Testing—Phase 3", Annual Technical Progress Report, Reporting Period: Oct. 1, 1996–Sep. 30, 1997.

"Utility Advanced Turbine System (ATS) Technology Readiness Testing and Pre–Commercial Demonstration", Quarterly Report, Jan. 1–Mar. 31, 1997, Document #666275, Report Numbers: DOE/MC/31176–07.

"Proceedings of the 1997 Advanced Turbine Systems", Annual Program Review Meeting, Oct. 28–29, 1997.

* cited by examiner

SYSTEM FOR CONTROLLING CLEARANCE BETWEEN BLADE TIPS AND A SURROUNDING CASING IN ROTATING MACHINERY

This is a continuation of application Ser. No. 09/163,389, filed Sep. 30, 1998, now abandoned.

The present invention relates to a system for supplying air at a controlled flow rate, pressure and temperature to enable control of the clearances between the blade tips and a surrounding casing in rotating machinery and more particularly relates to a system for controlling the flow of high pressure air at a control flow rate, pressure and temperature to control clearances between turbine blade tips and a surrounding turbine casing of a heavy-duty gas turbine during various operating modes of the turbine.

BACKGROUND OF THE INVENTION

While the present invention is described in this application in connection with a gas turbine, it will be appreciated that the invention is also applicable more generally to machinery having parts rotating past stationary surfaces, e.g., compressor blades rotating relative to a surrounding casing. The efficiency of a gas turbine can be increased by reducing the clearance between the tips of the turbine blades and their surrounding casing. However, to accommodate differential rates of thermal growth during start-up, acceleration, warm-up and steady-state operating modes, the turbine must be constructed with relatively large clearances between the rotating blade tips and the surrounding casing. For increased efficiency, these different modes of operation require thermal control of the casing, for example, during start-up, to cause the casing to expand, and during steady-state operations to cause the casing to contract to minimize the clearance with the blade tips. Previously, it has not been customary to provide turbomachinery blade tip clearance control in heavy-duty gas turbines. Simple clearance control systems have been employed in aircraft engines. These systems employ air bled from the engine's compressor or fan to cool the casing surrounding the turbine blades or to heat the rotor carrying the turbine blades. The problem confronted by the present invention is to provide a system for providing high pressure air at a regulated flow rate, pressure and temperature to heat or cool the turbine casing in accordance with various operating modes of the turbine.

BRIEF SUMMARY OF THE INVENTION

In accordance with the present invention, there is provided a closed-cycle compressed air system for supplying air to and transferring heat to or from a casing surrounding the rotating blades of the turbine to control the clearance between the casing and the tips of the rotating blades. During gas turbine start-up, the system heats the turbine casing, causing it to expand more rapidly than the rotor and accompanying blades to ensure that the blade tips do not contact the surrounding casing. During steady-state gas turbine operation, the system cools the turbine casing, reducing the clearance between the blade tips and the casing, thereby improving the efficiency of the turbine. Following turbine shutdown, the system can heat the turbine casing to maintain clearances (by ensuring that the casing remains relatively hot while the turbine blades cool down naturally).

In a preferred embodiment of the present system, air is supplied under pressure through an air control valve to the closed-circuit air system, the air supplied being derived from a charging compressor or an existing pressurized air supply.

To circulate the air about the system's closed circuit, a circulation compressor is provided in series with an upstream heat exchanger and a downstream air heater, with the gas turbine casing being located in series downstream of the air heater and upstream of the heat exchanger. The air heater heats the air exiting the circulation compressor for flow to the turbine casing. The heat exchanger is in heat exchange relation with a coolant supply whereby air exiting the casing and supplied to the circulation compressor is cooled.

In operating the system, two nominal temperature settings are employed for discharging air from the system to the turbine casing. During start-up, a high system discharge temperature is required to heat the casing. Consequently, the heater, downstream of the circulation compressor, heats the air in the air stream to maintain the required high system discharge temperature. During steady-state operation, the system cools the air supplied the turbine casing. Hence, a lower system discharge temperature is required. To provide the lower system discharge temperature, the heater is turned off and the system discharge temperature is regulated by controlling the supply of coolant to the heat exchanger whereby the temperature of the air exiting the heat exchanger and supplied the circulation compressor is predetermined. At all times, the system maintains the temperature at the inlet of the circulation compressor below a safe limit for operation of the compressor.

In a preferred embodiment according to the present invention, there is provided, in a system for controlling clearance between the tips of blades of rotating machinery and a surrounding casing during start-up and steady-state operating modes of the machinery wherein air is circulated in the surrounding casing at predetermined pressure, temperature and flow rate, a method of operating the system comprising the steps of heating the air prior to circulating the air through the casing during start-up to expand the turbine casing and cooling the circulating air exiting through the casing during steady-state operation, whereby clearances between the casing and the blade tips are maintained in both start-up and steady-state operating modes.

In a further preferred embodiment according to the present invention, there is provided a system for controlling clearance between the tips of blades of rotating machinery and a surrounding casing comprising a closed air circuit in communication with the casing of the rotating machinery and including a heat exchanger, a circulation compressor for circulating air in one direction through the air circuit, and an air heater connected in series with one another and with the casing, the air heater being disposed downstream of the circulation compressor and upstream of the casing, the heat exchanger lying downstream of the casing and upstream of the compressor, a bypass passage connected in the air circuit on opposite sides of the heat exchanger and a valve in the bypass passage, the air heater, when energized during start-up of the machinery, supplying heated air to the casing at a first temperature to expand the casing with the bypass valve open to flow air in the air circuit through the passage bypassing the heat exchanger, the bypass valve being closed during steady-state operations of the rotating machinery to enable the heat exchanger to supply cooled air to the casing at a second temperature lower than the first temperature to contract the casing and maintain a desired clearance between the casing and the blade tips.

Accordingly, it is a primary object of the present invention to provide a system for supplying high pressure, high temperature air at a controlled flow rate for circulation through a turbine casing to control the clearances between the tips of the blades of the rotating machinery and the casing in a controlled variable manner to change the clearances in accordance with the various modes of operation.

DETAILED DESCRIPTION OF THE INVENTION

Figure 1:
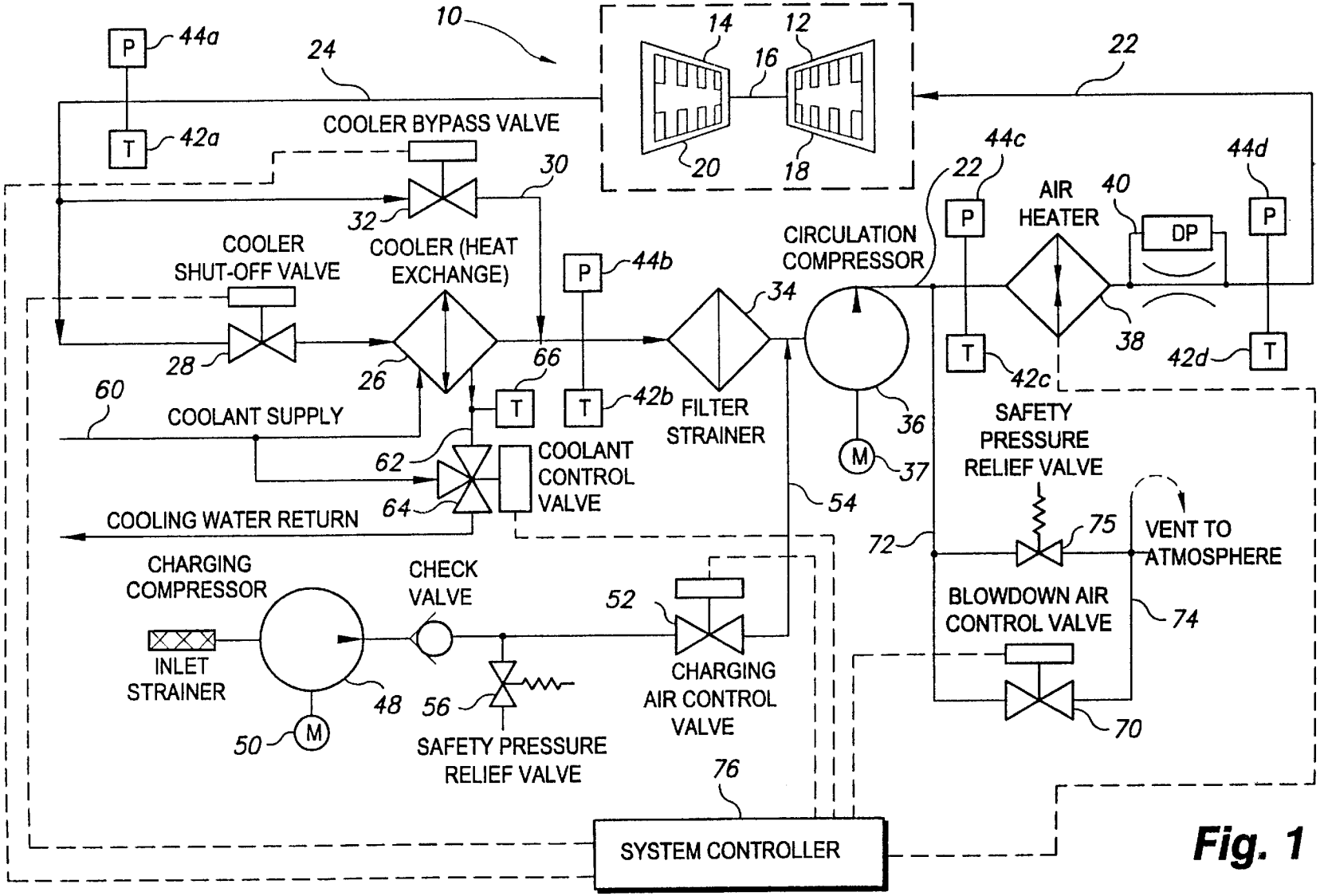
FIG. 1 is a schematic diagram illustrating a preferred embodiment of a clearance control system in accordance with the present invention.

Referring now to the drawings, particularly to FIG. 1, there is illustrated rotating machinery, i.e., a gas turbine, generally designated 10, comprised of a compressor section 12 and a turbine section 14 on a common shaft 16, each section having blades in association with a surrounding casing, i.e., casing sections 18 and 20, respectively. The casing surrounds the blade tips and include passages within the casing halves for receiving a heat exchange medium, e.g., air, at a controlled temperature, flow rate and pressure via an inlet line 22 whereby the casing can be expanded or contracted about the blades of the rotating machinery. For example, the air supplied via line 22 may be provided in passages in the forgings per se of the casing halves surrounding the blade tips by way of manifolds, not shown, with the air exhausting, similarly by way of manifolds, not shown, via an exit line 24.

The closed-circuit system of the present invention includes a heat exchanger 26 in exit line 24, preceded by a shutoff or isolation valve 28. For reasons which will become clear, a bypass line 30 with a bypass control valve 32 connects with exit line 24 upstream of valve 28 and downstream of the heat exchanger 26. The air exiting the gas turbine 10 via heat exchanger 26 or the bypass line 30, as explained below, passes through a filter/strainer 34 and is supplied to a circulation compressor 36 driven by an electric motor 37. The compressor 36 may comprise a centrifugal compressor which supplies air via the downstream line 22 to an air heater 38 which may comprise an electrical heater. The air exiting heater 38 passes through a flow meter 40 for return to the turbine casing. Temperature and pressure sensors 42, 44 are provided at various locations in the air circuit. For example, temperature and pressure sensors 42*a* and 44*a*, respectively, are provided in line 24 at the exit of the gas turbine; temperature and pressure sensors 42*b* and 44*b*, respectively, are provided at the exit to heat exchanger 26; temperature and pressure sensors 42*c* and 44*c*, respectively, are provided at the exit of the circulation compressor 36; and temperature and pressure sensors 42*d* and 44*d* are provided at the exit of the air heater 38 in line 22.

As illustrated in this preferred embodiment of FIG. 1, air is supplied from the atmosphere through a charging compressor 48 driven by an electric motor 50. The compressor 48 supplies air under pressure to a flow control valve 52 which communicates via line 54 with the air line 24 upstream of the circulation compressor 36 and downstream of the heat exchanger 26. A safety pressure relief valve 56 is provided in line 54 between the compressor 48 and flow control valve 52.

Heat exchanger 26 is in heat exchange relation with a supply of coolant. For example, cooling water may be supplied via line 60. It will be appreciated from a review of FIG. 1 that the heat exchanger 26 is a parallel flow heat exchanger having a coolant exit line 62 passing through a coolant control valve 64 for return to the coolant supply. It will be appreciated that a counterflow cooler can be provided if desired. A temperature sensor 66 is provided in the coolant exit line 62 from the heat exchanger 26.

Tapped into the main air supply line 22 via line 72 is an air control valve 70, the opposite side of valve 70 being vented to atmosphere at 74. A safety pressure relief valve 75 is provided between lines 72 and 74, bypassing control valve 70. Additionally, a system controller 76 is provided. As indicated by the dashed lines, the system controller controls the positions of the air shut-off valve 28, the air bypass valve 32, the coolant control valve 64, the charging air control valve 52 and a blow-down air control valve 70. Additionally, the temperature and pressure sensors 42 and 44, respectively, as well as temperature sensor 66 supply information to the system controller 76 whereby the system is controlled to open and close or modulate the various valves in accordance with a predetermined program. The system controller 76 may also control the operation of the air heater 38 as indicated by the dashed lines.

It will be appreciated that there are various modes of operation of the turbine, including start-up, steady-state and shutdown. The present system enables clearances between the casing and blade tips to be actively controlled by delivering air as a heat transfer medium at a temperature, pressure and flow rate which can be selected and controlled to obtain optimum clearance during each operational mode. The major operating parameters, i.e., flow rate, discharge temperature and pressure can be freely and independently adjusted to accommodate these different operating modes and the characteristics of different rotating machinery.

At start-up, the clearance control system is pressurized with air drawn from the atmosphere and compressed by the electric, motor-driven charging compressor 48. The compressed air passes through an open, charging air control valve 52 into the system's closed circuit, i.e., lines 22 and 24. The position of the charging air control valve 52 is regulated by the controller to achieve and maintain the required system operating pressure. When the system reaches the required operating pressure, the charging compressor 48 continues to supply air under pressure and the control valve 52 is modulated in response to a command signal from the system controller 76 to admit the necessary air flow to the system to make up for system air leakage. At about the same time, the circulation compressor 36 is started and circulates air about the system through the passages in the casing. Additionally, the heater 38 is actuated shortly after the circulation compressor 36 starts to increase the air temperature at the discharge of the system, i.e., at the discharge from line 22 to the casing of the turbine 10 at the desired air temperature. That is, a high system discharge temperature is required during start-up to heat the casing. The air heater 38 is regulated to provide the high system discharge set point temperature. Thus, during this start-up initial phase, hot air is discharged from the heater 38 and carried through piping to and about the casing, heating the casing and causing it to expand, thereby maintaining optimum clearance with the tips of the blades as the rotating machinery is starting to rotate. The air discharged via line 24 from the casing is returned to the circulation compressor via line 24. However, it will be appreciated that during this initial phase of the start-up, the air returned from the casing is relatively cool and cooling is therefore not required. Thus, at system start-up, the system controller 76 closes air shutoff valve 28 and opens bypass valve 32 whereby the exiting air from the turbine 10 bypasses heat exchanger 26.

As the start-up sequence continues, the temperature of the air rises. At a predetermined temperature, it is necessary to cool the air to protect the system equipment and, particularly, the circulation compressor 36 from failure due to exposure to temperature conditions above equipment design temperature. Consequently, the system controller 76, responsive to that predetermined temperature, opens shutoff valve 28 and closes the bypass valve 32 whereby air is passed through the heat exchanger 26. It will be appreciated that the temperature of the air exiting the heat exchanger 26 is regulated by controlling the flow rate of coolant through the heat exchanger 26. This is accomplished by the system controller 76 modulating the coolant control valve 64 in order to maintain a constant air temperature at the discharge of the circulation compressor 36. Consequently, the system continues to provide heated air to the casing, i.e., the system heats and thereby expands the casing until the casing reaches full-speed no-load operating conditions.

When the machinery is running under load conditions at steady-state, the clearance control system of the present invention cools the turbine casing to a temperature required for optimum turbine efficiency with optimum clearance between the casing and blade tips. Consequently, at steady-state, the air heater 38 is deenergized if it was not previously deenergized during the latter portion of the start-up phase. The lower system discharge temperature is achieved by deenergizing the air heater 38. Additionally, the coolant control valve 64 is controlled to control the flow of coolant through the heat exchanger 26 and hence regulate the temperature of the air exiting the heat exchanger 26. In the event of a system failure during this steady-state phase, the turbine 10 can continue to operate under these conditions, although at a lower efficiency.

To shut down the turbine, the system controller operates the system similarly as in the start-up mode. Thus, the heat exchanger 26 is bypassed and the air heater 38 is actuated. This maintains the casing in an expanded state as the rotor and blades cool naturally, thereby avoiding contact between the blade tips and the casing. The system is operated to supply heated air for a considerable period after shutdown, e.g., 24 hours to maintain the desired clearance.

Following gas turbine shutdown, it may be desirable to restart the turbine without first waiting for the rotating machinery to cool down completely. If so, it is necessary to maintain clearance between the tips of the blades and the surrounding casing. To achieve this, the system operates in the manner previously described with respect to the start-up of the system, i.e., the higher system discharge temperature is obtained by energizing the air heater 38 and bypassing the heat exchanger. It will be appreciated that system pressure is regulated by the charging air control valve 52 under control of the system controller 76. Also, the system pressure may be regulated by the vent control valve 70 which vents excess air from the system, likewise under the control of the system controller 76.

As noted previously, the lower set discharge temperature on the downstream side of the circulation compressor is regulated by modulating the position of the coolant control valve 64. This valve controls the flow rate of coolant through the heat exchanger 26. By increasing the flow of coolant, a lower air discharge temperature is obtained and vice-versa. While not shown, a small bypass line containing an orifice is installed around the control valve 64 to maintain a minimum flow through the cooler when the control valve is fully closed. The coolant control valve 64 is positioned by a signal from the system controller 76 to maintain a desired lower discharge set temperature measured at the discharge of the circulation compressor 36. This lower discharge set temperature maintains the casing heat transfer requirements for optimal clearance control and also is used such that maximum temperature limit of the circulation compressor is not exceeded. Further, the temperature of the coolant discharged from heat exchanger 26 is monitored by the system controller 76. If the temperature of the coolant approaches a boiling temperature, the controller opens the coolant control valve 64 to increase the flow rate and reduce the coolant temperature. This protects the heat exchanger 26 from damage from vaporization of the coolant which could occur under conditions where the coolant flow rate is low and the air inlet temperature is higher than the coolant boiling point but lower than the nominal design conditions, i.e., conditions where the air temperature control criterion calls for the coolant control valve to be closed or nearly closed.

During shutdown, as well as during start-up, a higher system discharge set temperature at the inlet to the casing is necessary to heat the casing and increase clearance. This is achieved by energizing the air heater 38. The air heater output can be adjusted by a suitable power control device or by switching the heating circuits on and off within the heater. It is not necessary to alter the cooling control set temperature when the heater is in operation.

It will be appreciated that the cooling control for the air circuit can be simplified by eliminating the heat exchanger isolation valve 28 and bypass valve 32. This, however, results in reduced thermal efficiency during start-up and may increase the time required to heat the turbine casing prior to starting the turbine. However, by eliminating the heat exchanger isolation valve 28 and bypass valve 32, the costs may be reduced and reliability increased.

Figure 2:
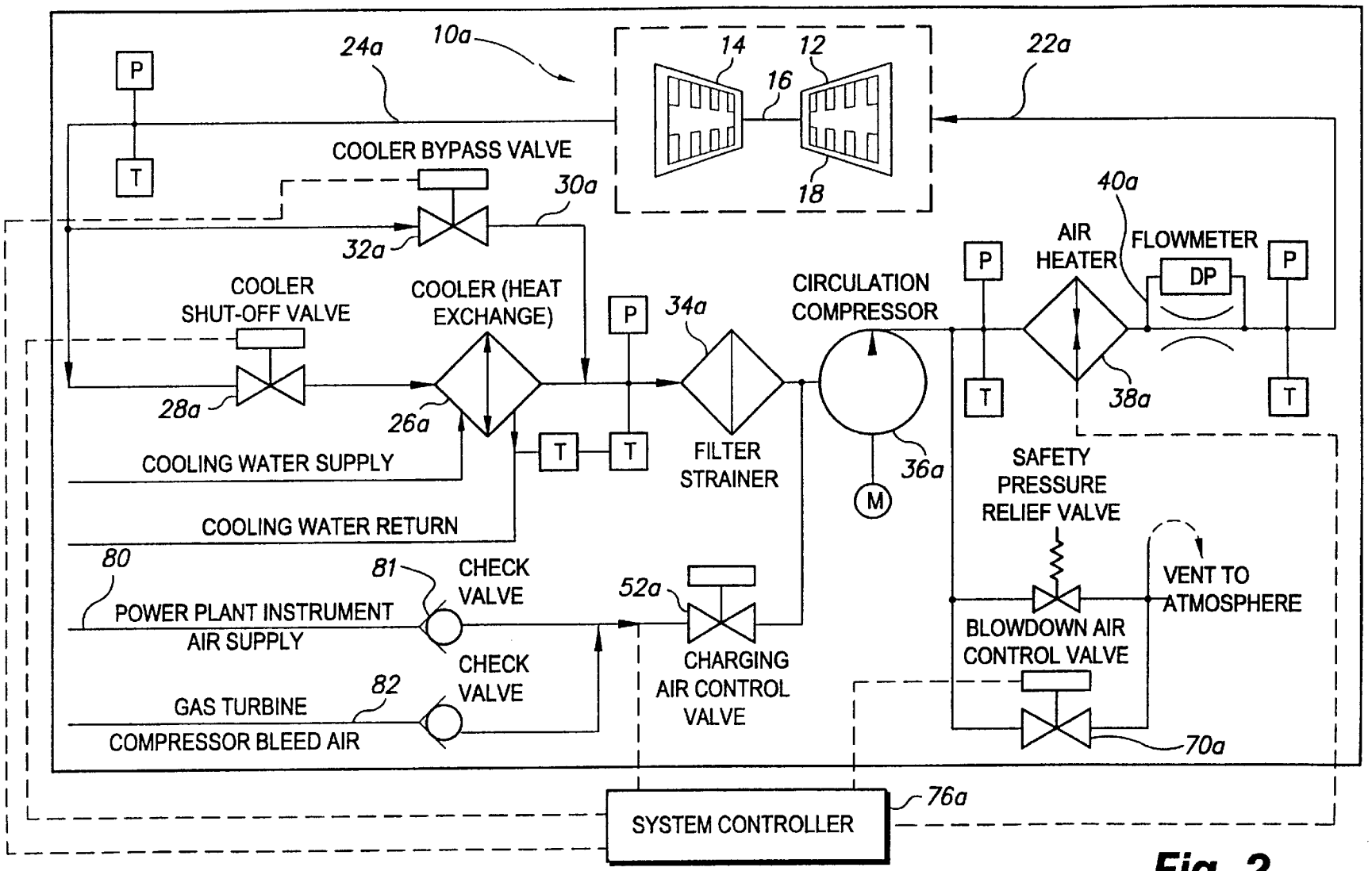
FIG. 2 is a similar schematic diagram of a further preferred embodiment of the present invention.

Referring now to FIG. 2 wherein like reference numerals designate like parts as in FIG. 1, followed by the suffix "a," there is illustrated an alternative clearance control system. In large power plants, compressed air systems exist which are capable of delivering pressurized air for the present system, e.g., air at 100 psig. Those air supply systems may be used to charge the present system and make up for any air leakage until the rotating machinery is started and has accelerated to a speed where the compressor discharge pressure exceeds the pressure available from the power plant air system. From that point onwards, the clearance control system employs air bled from the turbine, i.e., from the compressor to maintain system pressure. This results in reduced costs for clearance control system equipment by eliminating the system's dedicated charging compressor, i.e., the compressor 48 illustrated in FIG. 1. System reliability is also improved by simplifying the overall power plant and eliminating clearance control system's reliance on charging compressor(s) during steady-state operation.

Thus, as illustrated in FIG. 2, a power plant air supply line 80 supplies air into the system through the charging air control valve 52*a*. A line 82 is connected with the turbine compressor to supply compressor bleed air and is connected to line 80 downstream of a check valve 81 and upstream of valve 52*a*.

Also as illustrated in FIG. 2, the heat exchanger coolant flow is not controlled and full flow of coolant is allowed at all times. Temperature control is achieved by modulating the positions of the heat exchanger bypass and shutoff valves 32*a* and 28*a*, respectively, to mix varying ratios of hot (uncooled) and cold (cooled) air. The valve positions are regulated by the system controller 76*a* to maintain the desired air temperature measured at the discharge of the circulation compressor.

In either system illustrated in FIG. 1 or FIG. 2, an air-to-air heat exchanger can be used in lieu of the heat exchangers 26 and 26*a*. Thus, air temperature can be regulated in an air-to-air heat exchanger by operation of louvers in the coolant air stream or by varying cooling fan speed or by use of a variable pitch fan.

It will be appreciated that the objectives of the present invention have been fully accomplished. Particularly, active clearance control for the various modes of operation of the rotating machinery is achieved whereby optimum clearances between the rotating blade tips and the casing during those modes of operation are obtained. The system enables the clearances to be actively controlled by delivering a heat transfer medium at a controlled temperature, pressure and flow rate to achieve those optimum clearances. These major operating parameters, flow rate, temperature and pressure, are freely and independently adjustable to accommodate the different operating modes and characteristics of different rotating machinery, i.e., similar machinery with different capacities.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a system for controlling clearance between the tips of blades of rotating machinery and a surrounding casing during startup and steady-state operating modes of the machinery wherein air is circulated in the surrounding casing at predetermined pressure, temperature and flow rate, a method of operating the system comprising the steps of:

(a) providing a closed air-circulating system whereby air is recirculated through the casing, including providing a heat exchanger, a circulation compressor, and an air heater in series with the casing;

(b) during an initial phase in the startup mode of operation, heating the air by the air heater downstream of the circulation compressor to expand the turbine casing and bypassing air exiting the casing about the heat exchange, (c) during a phase of the startup mode of operation subsequent to the initial phase and prior to the steady-state mode of operation, (i) discontinuing the step of heating the air and (ii) cooling the air exiting the casing by passing the exiting air through the heat exchanger in heat exchange relation with a coolant to cool the air on an upstream side of the circulation compressor; and (d) cooling the circulating air exiting through the casing during steady-state mode of operation, whereby clearances between the casing and the blade tips are maintained in both startup and steady-state operating modes.

2. A method according to claim 1 including controlling the temperature of the air discharged from the circulation compressor by controlling the flow of coolant through the heat exchanger.

* * * * *

UNITED STATES PATENT AND TRADEMARK OFFICE

CERTIFICATE OF CORRECTION

PATENT NO. : 6,626,635 B1
APPLICATION NO. : 09/666611
DATED : September 30, 2003
INVENTOR(S) : Prowse et al.

It is certified that error appears in the above-identified patent and that said Letters Patent is hereby corrected as shown below:

In Column 1, immediately below the title, insert:

--The Government of the United States of America has rights in this invention pursuant to Contract No. DE-FC21-95MC31176 awarded by the U. S. Department of Energy.--

Signed and Sealed this

Twentieth Day of February, 2007

JON W. DUDAS
*Director of the United States Patent and Trademark Office*